US008042795B2

(12) United States Patent
Kern et al.

(10) Patent No.: US 8,042,795 B2
(45) Date of Patent: Oct. 25, 2011

(54) TRANSPORTING APPARATUS FOR DISCRETE SHEETS INTO ENVELOPES AND RELATED METHODS

(75) Inventors: Peter Kern, Guernsey (GB); Reinhard Buri, Donaueschingen/Pfohren (DE)

(73) Assignee: Kern International, Inc.

( * ) Notice: Subject to any disclaimer, the term of this patent is extended or adjusted under 35 U.S.C. 154(b) by 415 days.

(21) Appl. No.: 12/231,754

(22) Filed: Sep. 5, 2008

(65) Prior Publication Data

US 2010/0059919 A1 Mar. 11, 2010

(51) Int. Cl.
*B65H 7/08* (2006.01)

(52) U.S. Cl. ..... 270/58.06; 270/58.11; 271/150; 271/2

(58) Field of Classification Search ..... 270/58.06, 270/58.11; 271/149, 150, 2; 198/465.3; 53/473, 381.7
See application file for complete search history.

(56) References Cited

U.S. PATENT DOCUMENTS

| | | | | |
|---|---|---|---|---|
| 0,024,459 | A | 6/1859 | Hall | |
| 2,915,863 | A | 12/1959 | Kummer | |
| 3,253,384 | A | 5/1966 | Huck et al. | |
| 3,568,401 | A | 3/1971 | Bonsch | |
| 3,753,836 | A | 8/1973 | Buckholz | |
| 3,872,649 | A | 3/1975 | Wimmer | |
| 4,132,402 | A | 1/1979 | Morrison et al. | |
| 4,360,356 | A | 11/1982 | Hall | |
| 4,473,430 | A | 9/1984 | Voltmer et al. | |
| 4,605,457 | A | 8/1986 | Guy | |
| 4,649,691 | A | 3/1987 | Buckholz | |
| 5,191,751 | A | 3/1993 | Marzullo et al. | |
| 5,251,425 | A | 10/1993 | Kern | |
| 5,327,705 | A | 7/1994 | DeFigueiredo | |
| 5,487,254 | A | 1/1996 | Dronsfield | |
| 5,675,959 | A | 10/1997 | Hamma et al. | |
| 5,791,644 | A * | 8/1998 | Regimbal et al. | 270/58.12 |
| 5,816,773 | A * | 10/1998 | Fehringer et al. | 414/789.9 |
| 5,992,132 | A | 11/1999 | Auerbach | |
| 6,199,853 | B1 * | 3/2001 | Andoh et al. | 270/58.14 |
| 6,352,257 | B1 | 3/2002 | Todaro et al. | |
| 6,527,269 | B2 * | 3/2003 | Yamada et al. | 271/221 |
| 6,561,502 | B1 | 5/2003 | Flickner | |
| 6,755,411 | B2 * | 6/2004 | Janatka et al. | 271/2 |
| 7,159,860 | B2 * | 1/2007 | Sasahara | 270/58.14 |

(Continued)

FOREIGN PATENT DOCUMENTS

CA 2 373 321 11/2000

(Continued)

OTHER PUBLICATIONS

Cormac Kelliher; International Search Report and Written Opinion; Aug. 7, 2009; 15 pages; European Patent Office.

(Continued)

*Primary Examiner* — Patrick Mackey
(74) *Attorney, Agent, or Firm* — Wood, Herron & Evans, LLP

(57) ABSTRACT

An apparatus transports a discrete paper or film object in a machine direction for insertion into an envelope. A guide assembly of the apparatus includes opposed first and second channels facing one another for guiding the object in the machine direction, with the channels extending upwardly to thereby define an uphill path of travel for the object. A drive apparatus includes engaging elements for moving the object along the first and second channels. At least one support element holds the object against the guide assembly.

23 Claims, 6 Drawing Sheets

U.S. PATENT DOCUMENTS

| | | | | |
|---|---|---|---|---|
| 2006/0156876 | A1 | 7/2006 | Sussmeier et al. | |
| 2006/0249895 | A1 | 11/2006 | Kern | |
| 2007/0040316 | A1 | 2/2007 | Kern | |
| 2008/0087147 | A1 | 4/2008 | Sussmeier et al. | |
| 2008/0106022 | A1 | 5/2008 | Sussmeier et al. | |
| 2008/0258372 | A1 * | 10/2008 | Nakane et al. | 270/58.08 |
| 2008/0265483 | A1 * | 10/2008 | Herrmann | 270/58.08 |

FOREIGN PATENT DOCUMENTS

| | | |
|---|---|---|
| DE | 37 00 112 | 7/1988 |
| EP | 0 504 114 | 9/1992 |
| EP | 0 876 908 | 11/1998 |
| EP | 1 297 970 | 4/2003 |
| EP | 1 622 778 | 11/2004 |
| EP | 1 683 651 | 7/2006 |
| WO | 2004/1098905 | 11/2004 |

OTHER PUBLICATIONS

Third Office Action issued in related Chinese Patent Application No. 200380109842.0; Mar. 27, 2009; 8 pages; Chinese Patent Office.

Irina Becker; Invitation to Pay Additional Fees in related PCT patent application No. PCT/US2009/030538; Apr. 1, 2009; 5 pp.; European Patent Office.

Irina Becker; Invitation to Pay Additional Fees in related PCT patent application No. PCT/US2009/030549; Apr. 8, 2009; 5 pages; European Patent Office.

* cited by examiner

TRANSPORTING APPARATUS FOR DISCRETE SHEETS INTO ENVELOPES AND RELATED METHODS

CROSS-REFERENCE

This application is generally related to the following copending U.S. patent applications: Ser. No. 12/231,739, entitled "Apparatus for Guiding and Cutting Web Products and Related Methods;" Ser. No. 12/231,755, entitled "Envelope Conveying and Positioning Apparatus and Related Methods;" Ser. No. 12/231,753, entitled "Inserting Apparatus for Discrete Objects into Envelopes and Related Methods;" Ser. No. 12/231,730, entitled "Conveying Apparatus for Envelopes and Related Methods;" and Ser. No. 12/231,749, entitled "Transporting Apparatus for Web Products and Related Methods", all being filed on even date herewith and expressly incorporated herein by reference in their entirety.

TECHNICAL FIELD

The present invention generally relates to converting equipment and, more particularly, to apparatus for converting paper into sheets, collating and automatic envelope stuffing operations.

BACKGROUND

Converting equipment is known for automatically stuffing envelopes. Such equipment may include components for feeding a pre-printed web of paper, for cutting such web into one or more discrete sheets for collating sheets, and for feeding such discrete sheet collations into envelopes. Such equipment may further include components to convey the stuffed envelopes to a specified location. The industry has long known apparatus which accomplish these and other functions. However, improvements are needed where high volumes of paper piece count and high speeds are required without sacrificing reliability accuracy and quality of end product.

More particularly, a large roll of paper is typically printed in discrete areas with piece specific information. That is, the initial roll of paper comprises vast numbers of discrete areas of already-printed indicia-specific information with each discrete area defining what is to eventually comprise a single page or sheet of indicia specific information. To complicate the process, a variable number of sheets with related indicia must be placed into the envelopes so that the content of one envelope varies from the content of another by sheet count and, of course, by the specific indicia on the included sheets. As one example, financial reports of multiple customers or account specifics may require a varied number of customer or account specific sheets to be cut, respectively collated, stuffed and discharged for delivery. Thus, the contents of each envelope include either a single sheet or a "collation" of from two to many sheets, each "collation" being specific to a mailing to an addressee.

In such an exemplary operation, a financial institution might send billing or invoice information to each of its customers. The billing information or "indicia" for one customer may require anywhere from one final sheet to a number of sheets which must be collated, then placed in that customer's envelope. While all this information can be printed in sheet size discrete areas, on a single roll, these areas must be well defined, cut, merged or collated into sheets for the same addressee or destination, placed into envelopes, treated and discharged. Thus, a system for conducting this process has in the past included certain typical components, such as a paper roll stand, drive, sheet cutter, merge unit, accumulate or collate unit, folder, envelope feeder, envelope inserter, and finishing and discharge units. Electronic controls are used to operate the system to correlate the functions so correct sheets are collated and placed in correct destination envelopes.

In such multi-component systems, the pass-through rate from paper roll to finished envelope is dependent on the speed of each component, and overall production speed is a function of the slowest or weakest link component. Overall reliability is similarly limited. Moreover, the mean down time from any malfunction or failure to repair is limited by the most repair-prone, most maintenance consumptive component. Such systems are capital intensive, requiring significant floor plan or footprint, and require significant labor, materials and maintenance capabilities and facilities.

In such a system, it is sometimes necessary to transport a single discreet sheet or a stack of such sheets toward the envelopes as part of a stuffing operation. In conventional systems of this type, high speed transportation of the sheets may result in poor control of the sheets as they travel toward and into the envelopes. Lack of control may, for example, result in lifting of the sheets away from the plane of travel of the sheets. When a stack of sheets is processed, this lack of control may for example further result in the edges of the sheets not being aligned with one another.

Accordingly, it is desirable to provide an improved transportation apparatus and methods for handling discrete sheets and stacks of discrete sheets in a high speed handling machine. It is also desirable to provide a transportation system and related methods that address inherent problems observed with conventional paper systems. Moreover, it is desirable to provide a converting apparatus in the form of an automatic envelope stuffing machine that address the problems of conventional machines for stuffing envelopes.

SUMMARY

To these ends, in some embodiments, an apparatus transports and guides single objects or multiple objects in a stack upwardly to an envelope stuffing position. Drive lugs or fingers engage the trailing edges of the objects to move them along while lateral edges of the objects are confined by guides and while deflectable elements engage and retard the objects against the drive forces to confine and control the objects positively as they move along.

More particularly, in one particular embodiment of the invention, an apparatus is provided for transporting a discrete paper or film object in a machine direction for insertion into an envelope. The apparatus includes a guide assembly that includes opposed first and second channels for guiding the object in the machine direction, with the channels being oriented upwardly to thereby define an uphill path of travel for the object. A drive apparatus includes engaging elements extending transversely to the machine direction for moving the object along the first and second channels. At least one support element holds the object against the guide assembly.

The at least one support element may include a plurality of deflectable elements for engaging the object. The plurality of deflectable elements may include bristles. The deflectable elements may be oriented to apply a force on the object in a direction opposite the machine direction as the object travels in the machine direction. The deflectable elements may be arranged to apply a force against the object in a direction that is transverse to the machine direction during travel of the object in the machine direction. The engaging elements may be in the form of fingers that extend from a plane of travel of the object. The fingers may be configured to engage a trailing edge of the object to thereby move the object in the machine direction. At least one of the first or second channels includes a generally C-shaped profile. The guide assembly may include first and second leg members respectively defining the first and second channels and including respective distal ends that are configured to receive the envelope thereon.

The apparatus may include at least one extension element that is coupled to the guide assembly and configured to engage an interior of the envelope to thereby cause the envelope to open to receive the object therein. More particularly, the envelope is moved relative to the extension element to result in the envelope opening by action of the extension element. The extension element may be generally flat. At least one of the first or second channels may be tapered in the machine direction. The guide assembly and the drive apparatus may be configured to move a stack of the objects in the machine direction. The at least one support element may extend substantially along an entire length of the guide assembly.

In another embodiment, an apparatus is provided for transporting a discrete paper or film object or a stack of such objects in a machine direction for insertion into an envelope. The apparatus includes a guide assembly that includes opposed first and second leg members, each having at least a portion thereof including a generally C-shaped channel for guiding the objects in the machine direction. A drive apparatus includes engaging elements for moving the objects along the first and second channels. A pair of support elements hold the objects against the guide assembly and include a plurality of deflectable elements for engaging the object.

In yet another embodiment, an automatic envelope stuffing apparatus is provided. The apparatus includes a first end associated with feeding of a roll of paper in a machine direction, and a portion that is configured to process the roll of paper into discrete paper objects. A second end of the apparatus is associated with feeding of envelopes toward the discrete objects. A transporting apparatus of the apparatus transports the discrete objects towards the envelopes and includes a guide assembly that has opposed first and second channels for guiding the object in the machine direction, with the channels being oriented upwardly to thereby define an uphill path of travel for the objects. A drive apparatus includes engaging elements that extend transversely to the machine direction for moving the objects along the first and second channels. The transporting apparatus includes at least one support element for holding the objects against the guide assembly.

In another embodiment, a method is provided for transporting a discrete paper or film object or a stack of such objects in a machine direction for insertion into an envelope. The method includes guiding the objects in an upward direction and applying a force against a common trailing edge of the objects to move the objects in the machine direction. The method may include applying a drag force on the objects during travel thereof in the machine direction. The method may alternatively or additionally include applying a force on the objects in a direction that is transverse to the machine direction and transverse to a direction of gravity for controlling travel of the objects in the machine direction. The method may include restricting movement of the objects in at least four directions for controlling travel of the objects in the machine direction.

Such apparatus and methods are particularly useful in a paper converting and envelope stuffing system contemplating improved paper converting and sheet inserting apparatus and methods, modular based, and having improved paper handling apparatus, servo driven components, improved sensor density and improved control concepts controlling the system operation. One or more of the embodiments of the invention contemplate the provision of an improved envelope conveying apparatus which can be used as a module of a modular paper converting and sheet insertion system where human capital, required space, required equipment, maintenance, labor and materials and facilities therefore are reduced compared to conventional systems of similar throughput.

More specifically, such improved apparatus and methods contemplate a plurality of functional modules providing the following functions in a series of modules of like or dissimilar modules where a specific module is multi-functional. The functions comprise:

printed paper roll handling/unwinding;
paper slitting and cutting;
sheet collation and accumulation;
sheet folding;
transportation for interfacing with inserts;
envelope feeding;
collation interfacing and insertion; and
envelope treating and discharge.

More particularly, one or more aspects of the invention may contemplate, without limitation, new and unique apparatus and methods for:

(a) guiding a web of the paper or film containing the printed indicia into a cutter apparatus;
(b) processing the web through slitting and transverse-cutting operation;
(c) transporting and merging discrete pieces of the insert;
(d) accumulating predefined stacks of discrete pieces of the insert;
(e) guiding and transporting a stack of discrete pieces of the insert toward an envelope-filling station;
(f) transporting individual envelopes toward the envelope-filling station;
(g) creating and processing a stack of the envelopes prior to the envelope-filling process; and
(h) processing an individual envelope from the stack of envelopes and through the envelope-filling station.

While the combination of the particular functions in the particular modules are unique combinations, the invention of this application lies primarily in the paper transporting apparatus and methods described herein.

DETAILED DESCRIPTION

Figure 1:
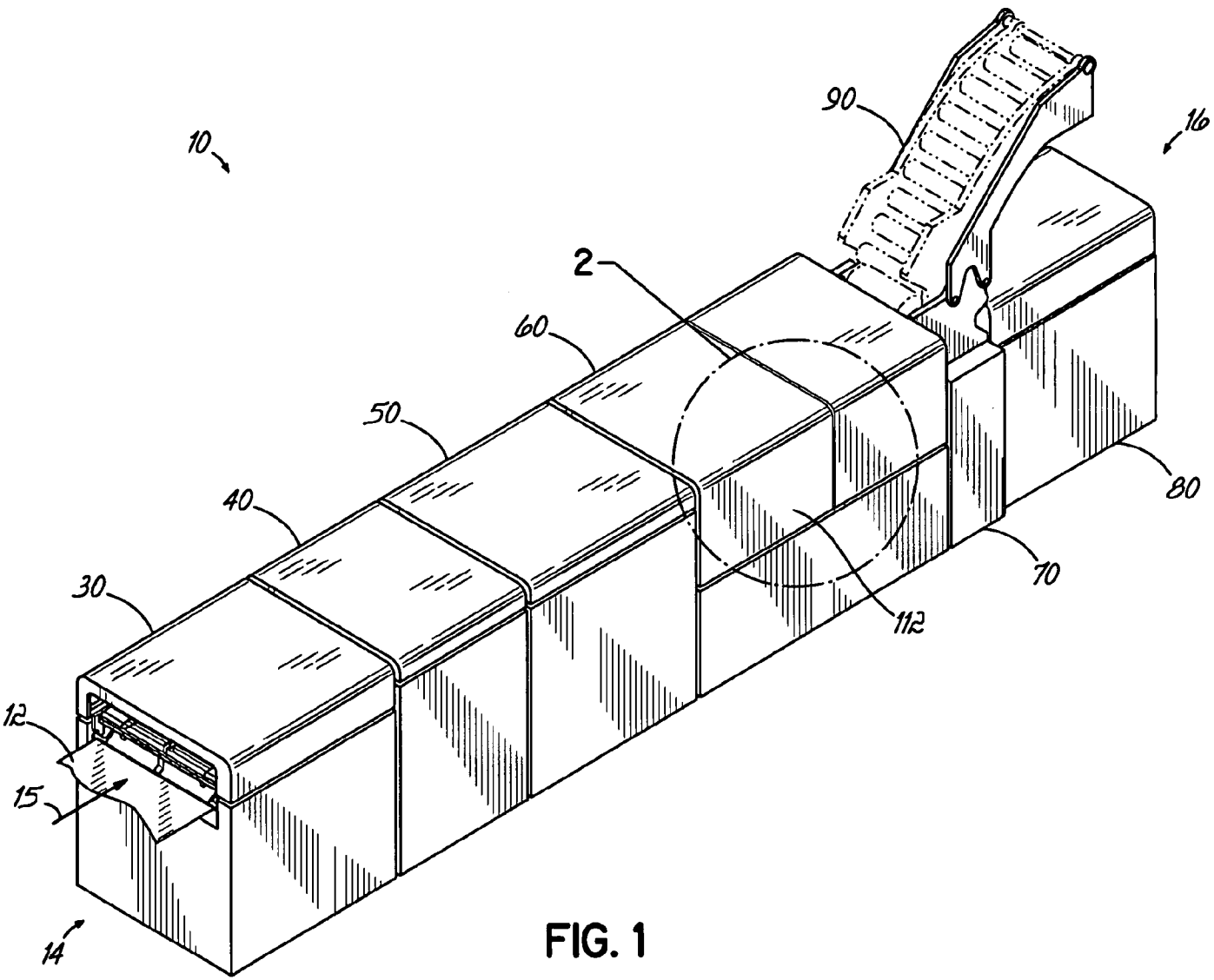
FIG. 1 is a perspective view illustrating a portion of a converter for stuffing envelopes with selected paper or film objects.

Referring to the figures and, more particularly to FIG. 1, a portion of an exemplary converter 10 is illustrated for processing a web 12 of paper or film. Although not shown, the web 12 processed by the converter 10 originates, for example, from a roll (not shown) of material containing such web. The roll is generally associated with a first end 14 of the converter 10 and is unwound in ways known in the art, for example, by driving a spindle receiving a core of the roll or by contacting a surface of the roll with a belt or similar apparatus. Typically, the web 12 is pre-printed with indicia in discrete areas.

The web 12 thus travels in a machine direction, generally indicated by arrow 15, through several modules that make up the converter 10. In the exemplary embodiment of FIG. 1, converter 10 cuts the web material into discrete sheets (corresponding to the "areas") of material ("inserts") and feeds them into envelopes fed generally from an opposite end 16 of converter 10. Converter 10 may further convey the envelopes containing the inserts away from the shown portion of the converter 10 for subsequent processing or disposition. The exemplary converter 10 includes, as noted above, several modules for effecting different steps in the processing of the web and the inserts resulting therefrom, as well as processing of the envelopes. Those of ordinary skill in the art will readily appreciate that converter 10 may include other modules in addition or instead of those shown herein.

A first of the shown modules, for example, is a cutting module 30 relatively proximate first end 14 of the converter 10 and which cuts the web 12 into discrete objects such as inserts (FIG. 2) for subsequent processing. A conveying module 40 controls and transports the discrete inserts received from the cutting module and feeds them into a folding and buffering module 50. Module 50 may, if necessary, form stacks of the discrete inserts for subsequent processing, for example, if the intended production requires stuffing the envelopes with inserts defined by more than one discrete sheet. Module 50 folds the discrete inserts, if required by the intended production, along a longitudinal axis of the discrete inserts disposed generally along the machine direction. Moreover, module 50 accumulates, collates or buffers sets of the discrete sheets into individually handled stacks, if the particular production so requires.

With continued reference to FIG. 1, an uptake module 60 takes the inserts from folding and buffering module 50 and cooperates with components of a stuffing module 70 to transport the inserts and feed them into envelopes. The envelopes, in turn, are handled and fed toward the stuffing module 70 by an envelope conveyor 80. A conveying assembly 90 is operatively coupled to the stuffing module 70 and the envelope conveyor 80 for conveying the stuffed or filled envelopes away from the shown portion of converter 10 for subsequent processing or disposition.

Figure 2:
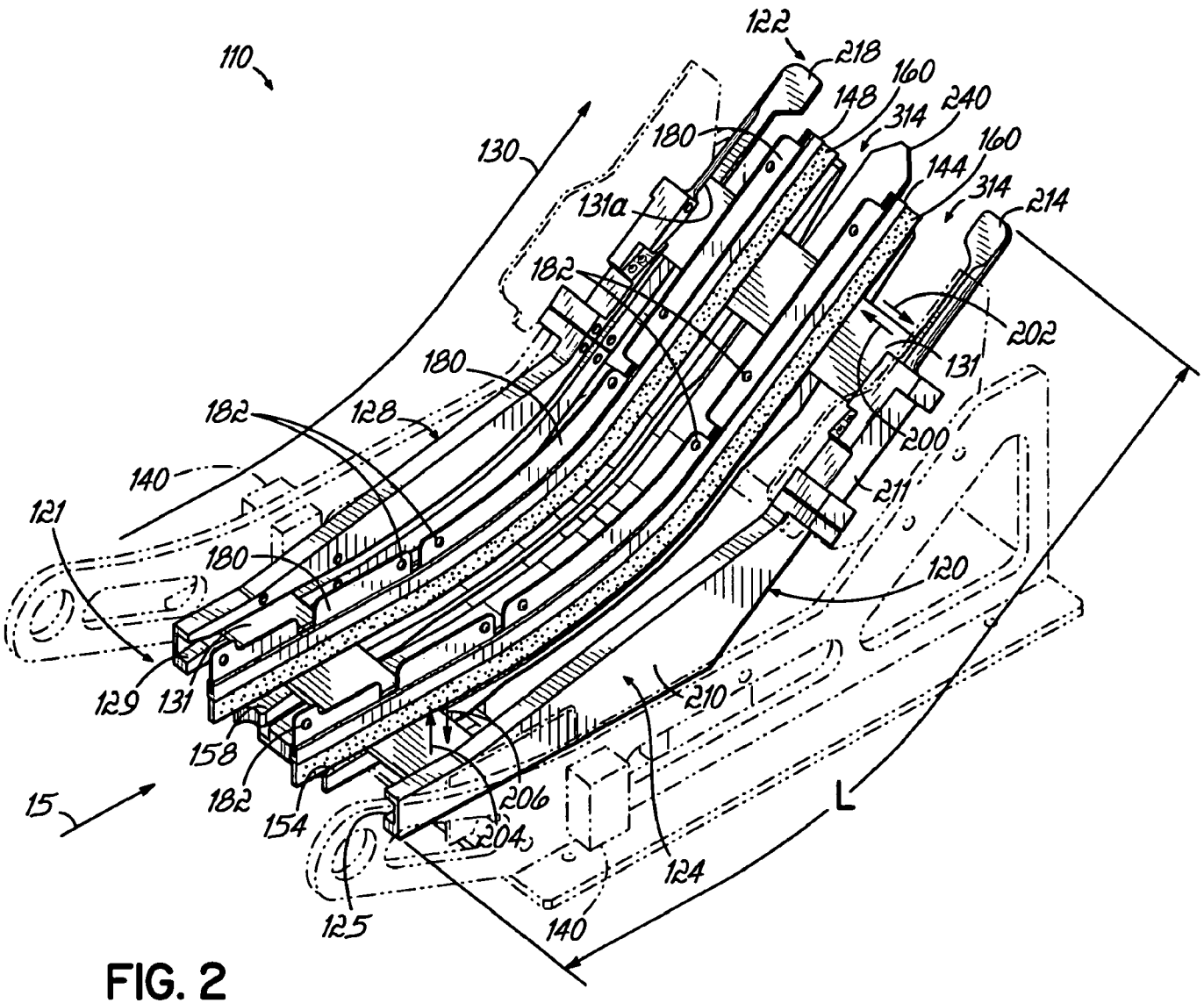
FIG. 2 is a perspective view of an interior portion of a transporting apparatus associated with the encircled area of FIG. 1.

With reference to FIGS. 2-6, and particular reference to FIG. 2, a portion of the transporting apparatus 110 of uptake module 60 is illustrated. Uptake module 60 includes a cover or lid 112 (FIG. 1) for limiting access to moving parts of module 60 and prevent debris and like materials from depositing on the inserts or envelopes. Transporting apparatus 110 includes a guide assembly 120 extending between first and second ends 121, 122 and which has first and second leg members 124, 128 in confronting relationship with one another. Guide assembly 120 provides a generally curved and uphill path of travel (arrow 130) of the discrete paper and/or film objects or inserts 131 toward the envelopes 132 (FIGS. 3 and 5) generally in the machine direction (arrow 15). To this end, each of the leg members 124, 128 includes a respective, lateral guide in the form of a channel 125, 129 that receives one of the lateral edges 131*a* of an insert 131 to thereby guide the insert 131 as it travels in the machine direction (arrow 15). Further details of channels 125, 129 are discussed in further detail below. As used herein, the term "insert" is intended to cover single discrete sheets of paper or film or a stack of discrete sheets of paper and/or film.

A pair of motors 140 (shown in phantom in FIGS. 2 and 5) permit automatic adjustment of the spacing between first and second leg members 125, 129 in response to a width of the insert 131 and further in response to a width of the envelopes 132. In this embodiment, each of the motors 140 is operatively coupled to one of the leg members 125, 129, for example through jack screws 142 (only one shown in FIG. 5) such that turning of shafts of motors 140 result in turning of the jack screws 142 which, in turn, advances the legs 125, 129 toward one another. Alternatively, it is contemplated that only one of the legs 125, 129 may be movable toward the other of the legs 125, 129, thereby similarly automatically adjusting the spacing between them in response to a width of the insert 131 and in response to a width of the envelopes 132. It is also contemplated that a single motor may control both of the legs 125, 129. Motors 140 may, for example, be stepper motors such as model HRA08C available from Sick Stegmann GmbH, a member of the Sick AG Group of Waldkirch, Germany.

Two support elements 144, 148 cooperate with the guide assembly 120 to hold the inserts 131 against the guide assembly 120 as the inserts 131 travel in the machine direction (arrow 15). More specifically, support elements 144, 148 extend substantially along the entire length L of guide assembly 120 and are disposed in confronting relationship against cooperating fixed surfaces 154, 158 of guide assembly 120. Fixed surfaces 154, 158 similarly extend substantially along the entire length "L" of guide assembly 120.

Figure 5:
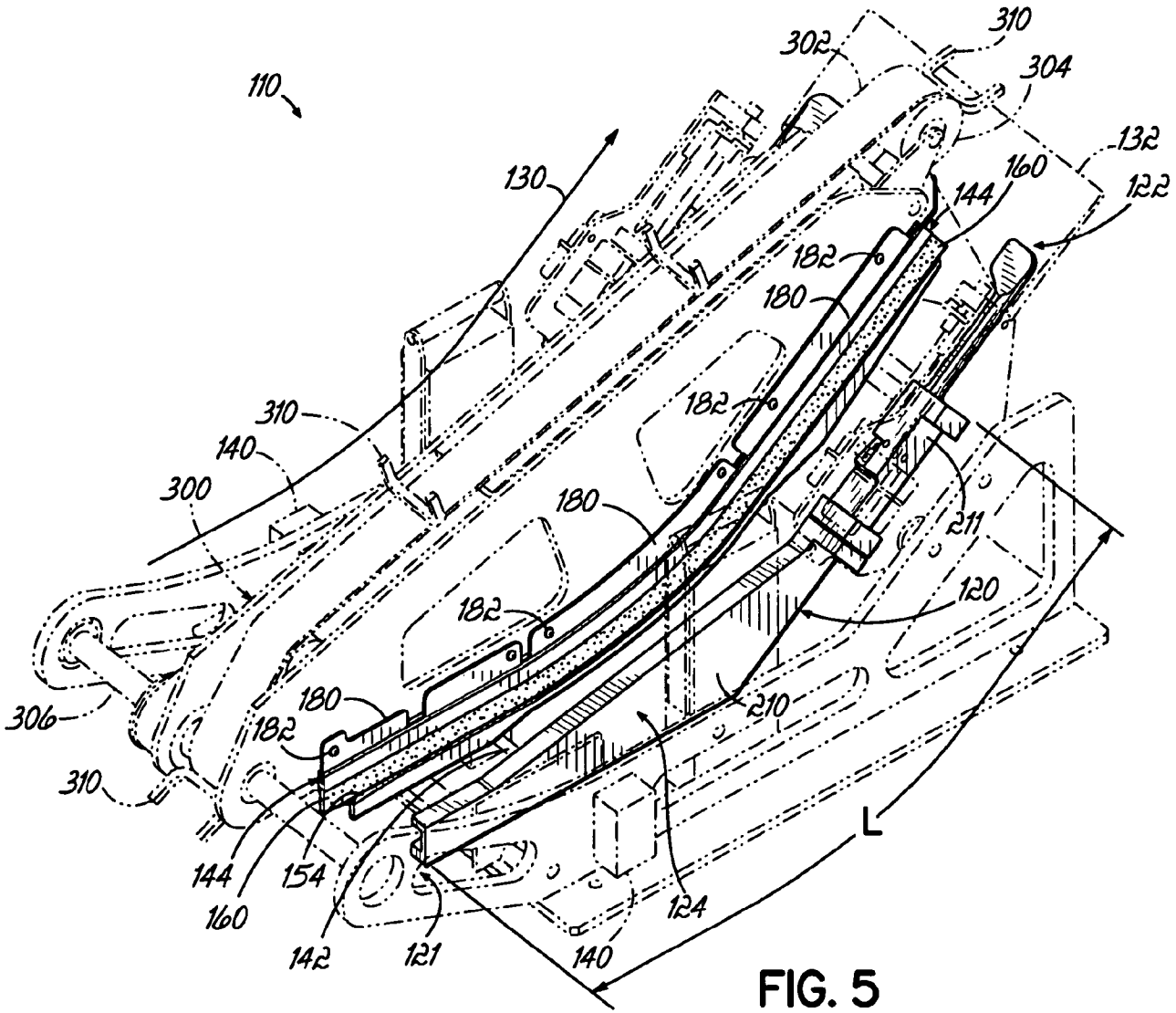
FIG. 5 is a view similar to FIG. 2 illustrating a drive apparatus of the transporting apparatus of FIG. 2.
Figure 6:
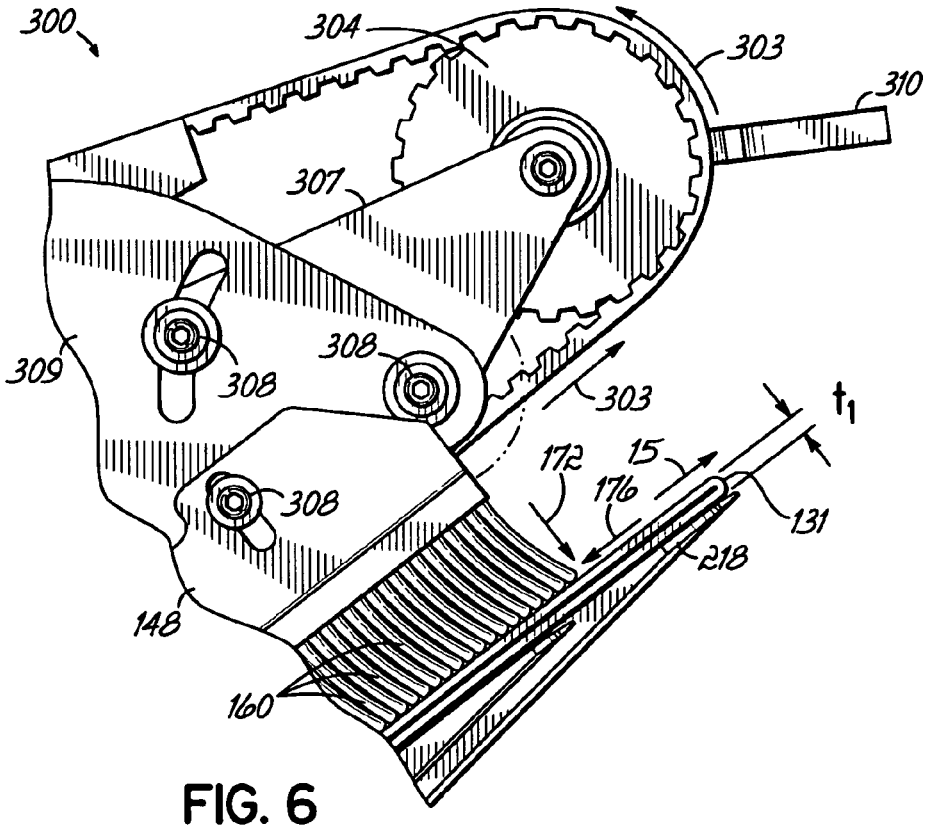
FIG. 6 is a view similar to FIG. 5A showing another stage in the processing of an exemplary insert.
Figure 7:
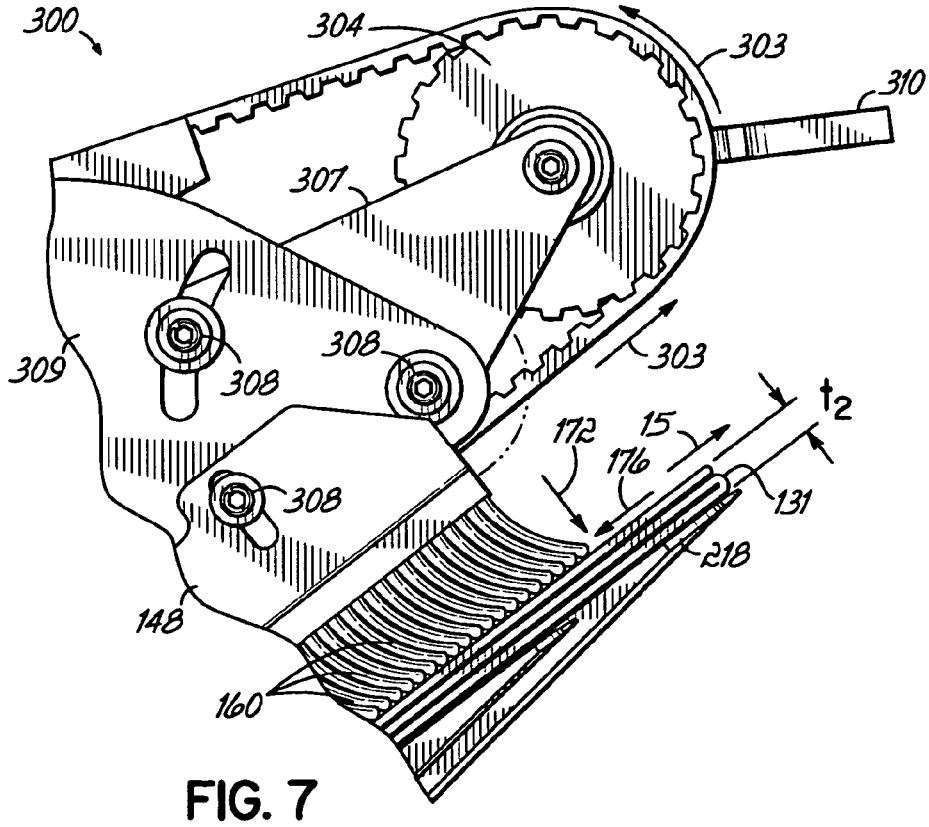
FIG. 7 is a view similar to FIG. 6 illustrating processing of an insert different from that shown in FIG. 6.

With continued particular reference to FIG. 2, each of support elements 144, 148 includes a plurality of deflectable elements in the form, in this exemplary embodiment, of bristles 160, diagrammatically illustrated in FIGS. 2 and 5, that engage the inserts 131. In this regard, the support elements 144, 148 are positioned, relative to fixed surfaces 154, 158, so as to provide a close fit between bristles 160 and the fixed surfaces 154, 158, thereby facilitating guidance of the inserts 131. More particularly, the position of support elements 144, 148 is suitably chosen to permit gentle and sturdy engagement of the bristles 160 with the inserts 131 (FIGS. 6-7). This engagement results in the exertion of a downward force (arrow 172 of FIGS. 6-7) by the support elements 144, 148 against the inserts 131. This downward force is in a direction transverse to the machine direction (arrow 15) and transverse to a direction of gravity (arrow 206, for example). Likewise, the engagement of bristles 160 similarly results in the exertion of a drag force on the inserts 131 e.g., in a direction opposite that of the machine direction (arrow 15), such as that represented by arrow 176 of FIGS. 6-7. These two forces (arrows 172 and 176 of FIGS. 6-7) cooperate to maintain the inserts 131 against fixed surfaces 154, 158 and thereby guide inserts 131 as they travel in the machine direction (arrow 15) toward the envelopes 132. Accordingly, these two forces minimize lifting or flapping of the inserts 131 as they travel along the length "L" of guide assembly 120.

While the exemplary embodiment of FIG. 2 includes two support elements 144, 148 and two fixed surfaces 154, 158 respectively associated with the support elements 144, 148, it is contemplated that alternate embodiments may include support elements and cooperating fixed surfaces in any number other than two or include no fixed surfaces at all. Likewise, it is contemplated that fixed surfaces 154, 158 may be replaced by a suitably chosen structure, so long as it provides a guiding functionality similar to that of transporting apparatus 110. Several braces 180 provide support to each of the support elements 144, 148. More particularly, braces 180 provide openings 182 positioned along the length "L" of guide assembly 120, for example, to permit structural coupling of support elements 144, 148 to a drive apparatus 300 (FIG. 5) of transporting apparatus 110 or other portions (shown in phantom) of module 60.

Figures 3, 4:
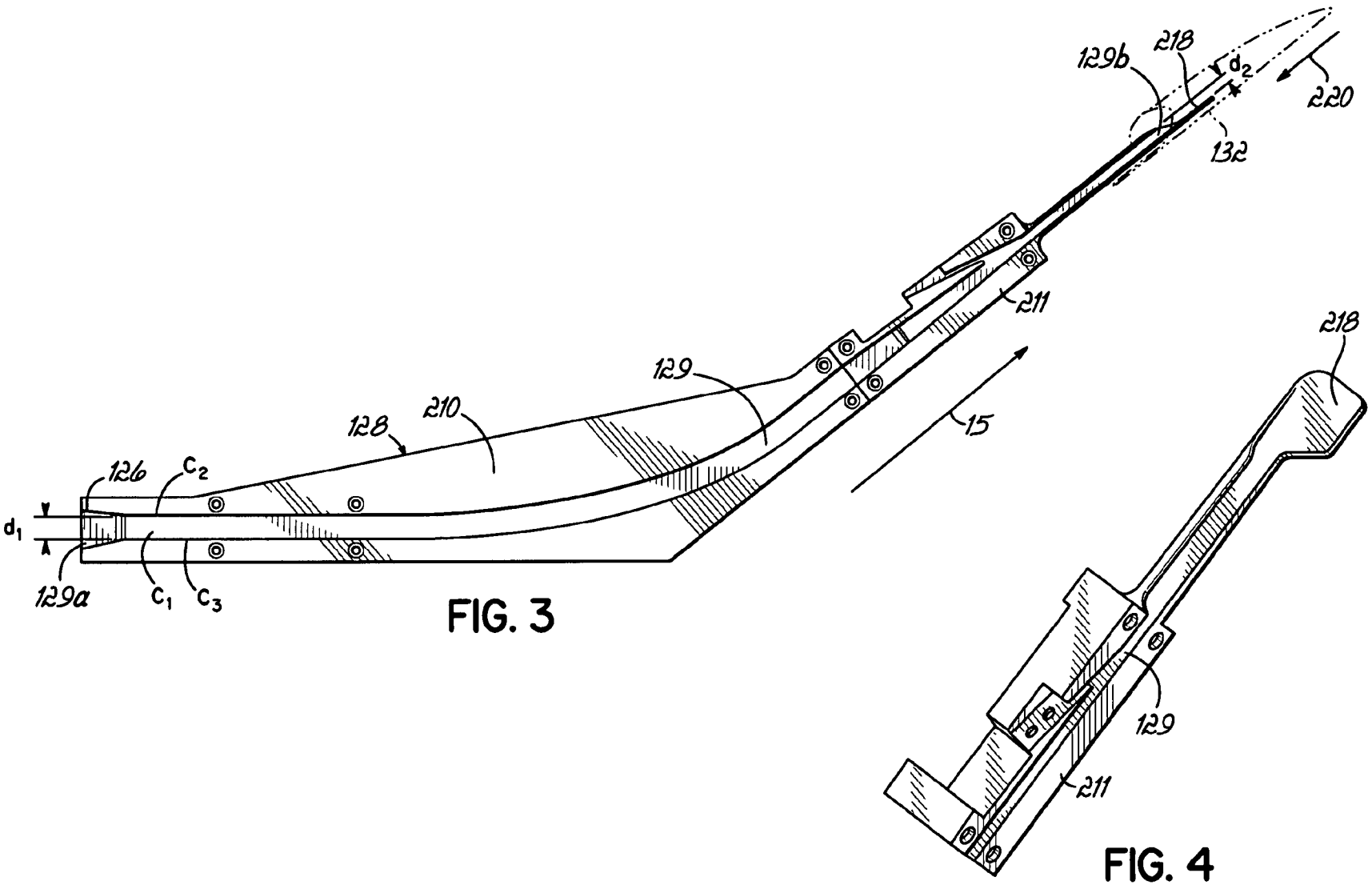
FIG. 3 is an elevation view of a portion of a guide assembly of the transporting apparatus of FIGS. 1-2.
FIG. 4 is a perspective view of a portion of the guide assembly of FIG. 3.

With continued particular reference to FIG. 2, and with further reference to FIGS. 3-4, and as discussed above, leg members 124, 128 include respective channels 125, 129 for guiding the inserts 131 as they travel in the machine direction (arrow 15). For simplicity of explanation, details are discussed with reference to only one of the two channels 125, 129, being understood that the same may apply to one or both of the channels 125, 129.

Channel 129 extends along a length of leg member 128 and defines open entry and exit ends 129*a*, 129*b* to respectively receive and discharge the inserts 131. In this exemplary embodiment, channel 129 includes a funnel or lip section 126 at the entry end 129*a* to facilitate receiving the lateral edges 131*a* of inserts 131 (FIG. 3). Channel 129 follows a generally upward orientation and thus defines a generally uphill path of travel (arrow 130 of FIG. 5) for the inserts 131 as they travel in the machine direction (arrow 15). In this exemplary embodiment, channel 129 tapers in the machine direction (arrow 15) to facilitate precise guidance of the inserts 131 as they transition from the exit end 129*b* and into an envelope 132 (FIG. 3). Accordingly, the channel 129 is smaller at its exit end 129*b* relative to the entry end 129*a*. More specifically, in this embodiment, channel 129 tapers from a first width $d_1$ to a second width $d_2$ smaller than the first width $d_1$.

With continued particular reference to FIGS. 2-4, at least a portion of channel 129 has a generally C-shaped cross-section or profile. The C-shaped profile thus defines a back wall $C_1$ and opposed top and bottom walls $C_2$, $C_3$ extending from the back wall $C_1$ for guiding the inserts 131. As used throughout the present disclosure, the terms "up," "down," "top," "bottom," "back," and derivatives thereof are not intended to be limiting but rather refer to the exemplary orientations shown in the figures. The C-shaped profile of this exemplary embodiment restricts travel of the inserts 131 in four directions. More specifically, the back wall $C_1$ restricts travel of the inserts 131 by providing a stopping or limiting surface for the edges 131*a* of inserts 131. In this regard, therefore, back wall $C_1$ restricts movement of inserts 131 in a first direction (arrow 200 of FIG. 2), while a corresponding back wall $C_1$ (not shown) of channel 125 restricts movement of inserts 131 in a second direction (arrow 202 of FIG. 2) opposite the first direction. Top wall $C_2$ and bottom wall $C_3$ of channel 129 restrict movement of the inserts 131 respectively upward and downward (arrows 204, 206).

Restriction of movement of the insert 131 in four directions facilitate precise guidance of inserts 131 as they travel in the machine direction (arrow 15) toward the envelopes 132 (shown in phantom in FIG. 3). Other structures of transporting apparatus 110 similarly facilitate guidance of the inserts 131 into envelopes 132. More particularly, a pair of generally flat extension elements 214, 218 respectively extend from the leg members 124, 128 to facilitate insertion of the inserts 131 into the envelopes 132. In operation, the flat extension elements 214, 218 receive an envelope 132 moving toward them in the direction of arrow 220, in such way so as to cause the envelopes 132 to open, thereby exposing the interior of the envelopes 132, as shown in FIG. 3. The extension elements 214, 218, moreover, maintain the envelope 132 in an open position during the insertion operation. An exemplary apparatus and method for feeding the envelopes 132 toward the extension elements is disclosed in U.S. patent application Ser. No. 10/553,969, titled "Device for Inserting Sheets into an Envelope," having a filing date of May 12, 2003, and the contents of which are herein incorporated by reference in its entirety.

With continued particular reference to FIGS. 2-4, the channel 129 of this exemplary embodiment has a generally constant C-shape profile along a first structural portion 210 of leg member 128. The C-shape profile tapers in the machine direction (arrow 15) along a second structural portion 211 of leg member 128 that is coupled to the first structural portion 210. It is contemplated that, alternatively, the entire length of channel 129 may be tapered or not be tapered at all. Likewise, it is contemplated that channel 129 may alternatively extend along an integrally formed leg member 128, rather than one made up of two structural portions 210, 211 coupled to one another, as in the exemplary embodiment of FIGS. 2-4.

Each of the generally flat extension elements 214, 218 of this exemplary embodiment is respectively integrally formed with the second structural portions 211 of each of the leg members 124, 128. Accordingly, in operation, an envelope 132 is pushed so as to surround the exit end 129*b* of channel 129, as shown in FIG. 3, while simultaneously permitting insert 131 to be moved in the machine direction (arrow 15) into the interior of envelope 132.

With continued particular reference to FIGS. 2-4, in this particular embodiment a third extension element is coupled to the guide assembly 120 to facilitate guidance of the inserts 131 into envelopes 132. More particularly, a centrally located, generally flat extension element 240 is positioned between the extension elements 214, 218, is coupled to an underside of guide assembly 120, and similarly engages the interior of envelopes 132 as these move toward the extension elements 214, 218, 240. While this exemplary embodiment includes two outer extension elements 214, 218 and a centrally located extension element 240, it is contemplated that alternative embodiments may have extension elements in a different number, position, and/or different shapes or have no extension elements at all.

With particular reference to FIGS. 5, 5A, and 6-7, movement of the inserts 131 in the machine direction (arrow 15) is provided by a drive apparatus 300, shown in phantom in FIG. 5, and which engages and moves the inserts 131. Drive apparatus 300 includes a toothed belt assembly 302 rotatable in a closed loop (arrows 303) and driven by a toothed wheel or roller 304 and cooperating rollers 306 disposed so as to position belt assembly 302 substantially along the entire length "L" of guide assembly 120. Toothed wheel or roller 304 is supported via a plate 307 and fasteners 308 from a main frame 309 of transporting apparatus 110. Toothed wheel or roller 304 is similarly coupled, via plate 307, to each of the support elements 144, 148 such that drive apparatus 300 and the support elements 144, 148 can be lifted simultaneously away from guide assembly 120. Drive apparatus 300 includes a plurality of fingers 310 spaced along the length of the belt assembly 302 and extending therefrom to engage the trailing edges 131*s* of the inserts 131.

Figure 5A:
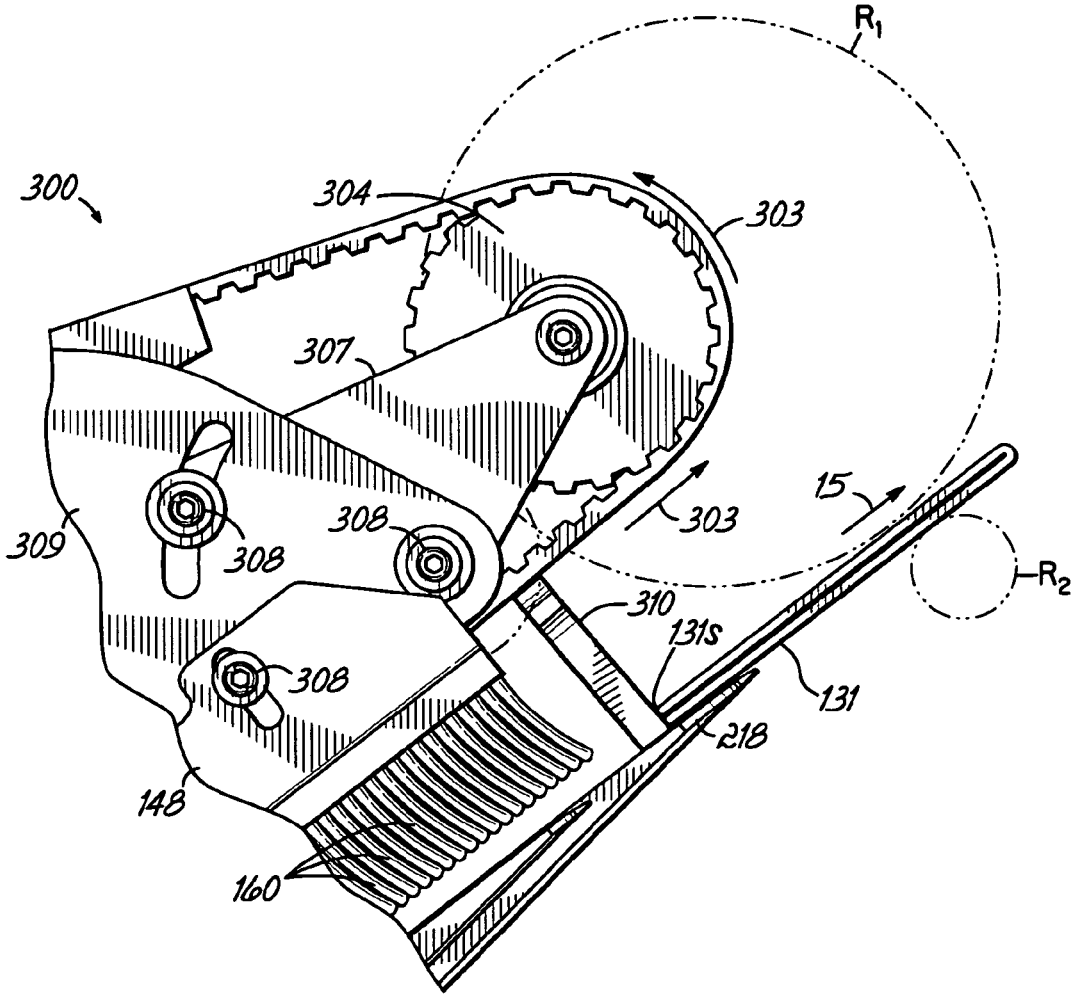
FIG. 5A is an elevation view of an end portion of the transporting apparatus of FIG. 2 processing an exemplary insert.

With particular reference to FIGS. 5-5A, fingers 310 are arranged in pairs such that the inserts 131 may be engaged at two points (only one shown in FIG. 5A) along the trailing edges 131*s* of the inserts 131 as they travel in the machine direction (arrow 15). In this regard, drive apparatus 300 is also positioned such that the fingers 310 penetrate open spaces 314 (FIG. 5) between the extension element 240 and the fixed surfaces 154, 158, thereby providing stopping or limiting surfaces against which the trailing edges 131*s* of the inserts abut. In operation, as the inserts 131 travel in the machine direction (arrow 15) guided by the guide assembly 120, the drag and downward forces (arrows 172 and 206 of FIG. 2) retard the inserts 131 against the fingers 310 such that stacked individual sheets making up an insert 131 become aligned with one another along their respective trailing edges 131*s*, as illustrated in FIG. 5A. Accordingly, the fingers 310 facilitate insertion of a stack of sheets in alignment or registration with one another. Once the insert 131 is inserted into the envelope 132, the resulting stuffed envelope is taken away by components such as, for example, rollers $R_1$ and $R_2$ (shown in phantom) of an envelope feeding and/or conveying apparatus for further disposition.

With particular reference to FIGS. 5 and 6, a feature of the exemplary deflectable elements in the form of bristles 160 is illustrated. Bristles 160 are shown deflecting to accommodate the thickness of inserts 131. Accordingly, FIG. 5 shows the bristles 160 deflecting to a first degree associated with a first thickness $t_1$ of an insert 131. FIG. 4 shows the bristles 160 deflecting to a second degree associated with a second thickness $t_2$ of an insert 131 larger than the first thickness $t_1$.

As used herein, the term "deflectable elements" refer to solid structures that flex in reaction to a force exerted upon them. In this regard, while the deflectable elements of the embodiment of FIGS. 2-7 are in the form of bristles 160, it is contemplated that the deflectable elements could alternatively take on other forms, so long as they provide at least some of the functionality described in this disclosure. For example, and without limitation, these could take the form of flexible flaps or other structures.

While the present invention has been illustrated by a description of various embodiments and while these embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of the general inventive concept.

What is claimed is:

1. An apparatus for transporting a discrete paper or film object in a machine direction for insertion into an envelope, comprising:

a guide assembly including opposed first and second channels for guiding the object in the machine direction, said channels being oriented upwardly thereby defining an uphill path of travel for the object;

a drive apparatus including engaging elements extending transversely to the machine direction for moving the object along said first and second channels; and at least one support element for holding the object against said guide assembly and extending substantially along an entire length of said guide assembly, wherein said at least one support element includes a plurality of deflectable elements for engaging the object.

2. The apparatus of claim 1, wherein said plurality of deflectable elements include bristles.

3. The apparatus of claim 1, wherein said deflectable elements are arranged to apply a force on the object in a direction opposite the machine direction as the object travels in the machine direction.

4. The apparatus of claim 1, wherein said deflectable elements are oriented to apply a force against the object in a direction transverse to the machine direction during travel of the object in the machine direction.

5. The apparatus of claim 1, wherein said engaging elements are in the form of fingers extending from a plane of travel of the object.

6. The apparatus of claim 5, wherein said fingers are configured to engage a trailing edge of the object to thereby move the object in the machine direction.

7. The apparatus of claim 1, wherein at least one of said first or second channels includes a generally C-shaped profile.

8. The apparatus of claim 1, wherein said guide assembly includes first and second leg members respectively defining said first and second channels and including respective distal ends configured to receive the envelope thereon.

9. The apparatus of claim 8, further comprising:

at least one extension element coupled to said guide assembly and configured to engage an interior of the envelope to thereby cause the envelope to open to receive the object therein.

10. The apparatus of claim 9, wherein said at least one extension element is generally flat.

11. The apparatus of claim 1, wherein at least one of said first or second channels is tapered in the machine direction.

12. The apparatus of claim 1, wherein said guide assembly and said drive apparatus are configured to move a stack of the objects in the machine direction.

13. An apparatus for transporting a discrete paper or film object in a machine direction for insertion into an envelope, comprising:

a guide assembly including opposed first and second channels for guiding the object in the machine direction, said channels being oriented upwardly thereby defining an uphill path of travel for the object;

a drive apparatus including engaging elements extending transversely to the machine direction for moving the object along said first and second channels;

at least one support element for holding the object against said guide assembly and extending substantially along an entire length of said guide assembly; and further comprising a fixed surface in confronting relationship with said at least one support element and extending substantially along the entire length of said guide assembly for supporting the object traveling uphill.

14. The apparatus of claim 1, wherein said guide assembly includes first and second leg members respectively defining said first and second channels, further comprising a motor operatively coupled to at least one of said first and second leg members for automatically moving said at least one of said first and second leg members toward the other of said first and second leg members in response to a width of the envelope.

15. The apparatus of claim 14, wherein said motor is operatively coupled to said first and second leg members for moving both of said first and second leg members toward one another.

16. An apparatus for transporting a discrete paper or film object or a stack of such objects in a machine direction for insertion into an envelope, comprising:

a guide assembly including opposed first and second leg members each having at least a portion thereof including a generally C-shaped channel for guiding the objects in the machine direction;

a drive apparatus including engaging elements for moving the objects along said first and second channels; and a pair of support elements for holding the objects against said guide assembly and including a plurality of deflectable elements for engaging the object, said support elements extending substantially along an entire length of said guide assembly.

17. A converting apparatus comprising:

a first end associated with feeding of a roll of paper in a machine direction;

a portion configured to process the roll of paper into discrete paper objects;

a second end associated with feeding of envelopes toward the discrete objects; and a transporting apparatus for transporting the discrete objects toward the envelopes, said transporting apparatus including:

(a) a guide assembly including opposed first and second channels for guiding the objects in the machine direction, said channels being oriented upwardly thereby defining an uphill path of travel for the objects, and (b) a drive apparatus including engaging elements extending transversely to the machine direction for moving the objects along said first and second channels, and (c) at least one support element for holding the objects against said guide assembly and extending substantially along an entire length of said guide assembly, wherein said at least one support element includes a plurality of deflectable elements for engaging said discrete objects.

18. A method of transporting a discrete paper or film object or a stack of such objects in a machine direction for insertion into an envelope, comprising:

guiding the objects in an upward direction along a guiding channel;

applying a force against a common trailing edge of the objects to move the objects in the machine direction;

holding the object against an entire length of said guiding channel by engaging the objects with a plurality of deflectable elements; and applying a drag force on the objects during travel thereof in the machine direction, the force being applied substantially along the entire length of the guiding channel.

19. The method of claim 18, further comprising:

applying a force on the objects in a direction transverse to the machine direction for controlling travel of the objects in the machine direction.

20. The method of claim 18, further comprising:

restricting movement of the objects in at least four directions for controlling travel of the objects in the machine direction.

21. The method of claim 18, further comprising:

guiding the objects in the upward direction along a pair of guiding channels engaging lateral edges of the objects; and automatically adjusting a distance between the guiding channels in response to a width of the envelope.

22. The method of claim 18, further comprising:

aligning respective trailing edges of objects in a stack relative to one another during travel of the stack in the machine direction.

23. The method of claim 18, wherein guiding the objects in an upward direction defines a concave uphill path of travel of the objects.

* * * * *